US006481129B2

(12) United States Patent
Kao

(10) Patent No.: US 6,481,129 B2
(45) Date of Patent: Nov. 19, 2002

(54) COIN-OP BULLETIN BOARD

(76) Inventor: Min-Kuei Kao, 5F, No. 14-1, Lane 12, Hsueh Shih, Rd., Tu-Cheng City, Taipei Hsien (TW)

( * ) Notice: Subject to any disclaimer, the term of this patent is extended or adjusted under 35 U.S.C. 154(b) by 122 days.

(21) Appl. No.: 09/783,552

(22) Filed: Feb. 15, 2001

(65) Prior Publication Data

US 2002/0108282 A1 Aug. 15, 2002

(51) Int. Cl.[7] ..... G09F 11/12
(52) U.S. Cl. ..... 40/472; 198/691; 40/605
(58) Field of Search ..... 198/502.1, 691; 232/15, 16; 271/193; 40/472, 605, 611

(56) References Cited

U.S. PATENT DOCUMENTS 1,017,563 A * 2/1912 Lain et al. ..... 40/611
4,526,357 A * 7/1985 Kuehnle et al. ..... 271/193 X
4,722,527 A * 2/1988 Gauselmann ..... 40/475 X
5,072,533 A * 12/1991 Doepgen et al. ..... 40/472 X
5,176,374 A * 1/1993 Yamada ..... 198/691 X
5,280,308 A * 1/1994 Takahashi et al. ..... 271/193 X
5,358,094 A * 10/1994 Molinaro et al. ..... 198/502.1
5,440,321 A * 8/1995 Hine, Jr. ..... 40/611 X
5,680,721 A * 10/1997 Hine, Jr. ..... 40/611
6,044,961 A * 4/2000 Hine ..... 198/502.1

* cited by examiner

*Primary Examiner*—Joanne Silbermann
(74) *Attorney, Agent, or Firm*—Rabin & Berdo, P.C.

(57) ABSTRACT

A coin-op bulletin board includes a box with a transparent front panel, a static electricity conveyer, a paper entrance with a pair of rollers as paper feeder, a paper guiding board, a bottom hole beneath the paper guiding board, a thin plate close to the top of the conveyer, a motor to drive the conveyer, a coin machine. A user can drop coins then put the advertisement or message into the paper entrance; the pair of rollers feeds the paper to the static electricity conveyer; the paper can stick to the static electricity conveyer and display for a preset period of time. After a period of time, the conveyer rolls and sends the paper to the thin plate and to the paper guiding board; the paper is finally dropped to the recycle box through the bottom hole.

3 Claims, 5 Drawing Sheets

COIN-OP BULLETIN BOARD

BACKGROUND OF THE INVENTION

I. Field of the Invention

This invention relates generally to a coin-op bulletin board and, more specifically, to a coin op bulletin board that collects coins as fee and displays message and advertisement in the front panel for a certain period of time. After a certain period of time the message or advertisement will drop into a recycle box of the coin-op bulletin board, and the display location on the coin-op bulletin board is available for next user.

II. Description of the Prior Art

Heretofore, some companies for product promotion purpose, paste up advertisement on wall randomly, such cause mess situation around neighborhood. To improve this, set up a bulletin board openly for the public on definite location for advertisement or message is a better way. However general public can paste the advertisement freely, this makes the bulletin board not neat and clean. Since the bulletin board is open to the public, people can stick the advertisement with glue, tape or pin; it is very difficult to clean up afterward. The new advertisements will cover the old ones from be seen. Therefore the public bulletin board is not very effective.

One way to resolve the issue for neat and clean is to have the bulletin board cover with a transparent panel, and have special people to manage it. The publics have go to the manager for key and place the advertisement on certain definite location. It is not too convenient for the general public, and it is a waste to have people to manage the bulletin board.

SUMMARY OF THE INVENTION

It is therefore an object of the invention to provide a coin-op bulletin board in which is easy to maintain and clean up. Users can display their advertisements or messages by coins for a period of time. The advertisements or messages will drop into a recycle box after the preset time to be clear up in an easier way.

In order to achieve the objectives set forth, a coin-op bulletin board in accordance with the present invention comprises a box with a transparent front panel. Inside the box further contains a static electricity conveyer, a paper entrance with a pair of rollers as paper feeder, a paper guiding board, a bottom hole beneath the paper guiding board, a top hole on top of the box and above the paper guiding board, a thin plate close to the top of the static electricity conveyer, a motor to drive the conveyer and rollers, a coin machine with a coin slot to control the motor. A user can drop coins then put the advertisement or message into the paper entrance; the pairs of rollers feeds the paper to the conveyer with static electricity; the paper can stick to the conveyer via static electricity and display for a preset period of time. At the due time, the conveyer rolls and sends the paper to the thin plate and to the paper guiding board; the paper is finally dropped to the recycle box through the bottom hole.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
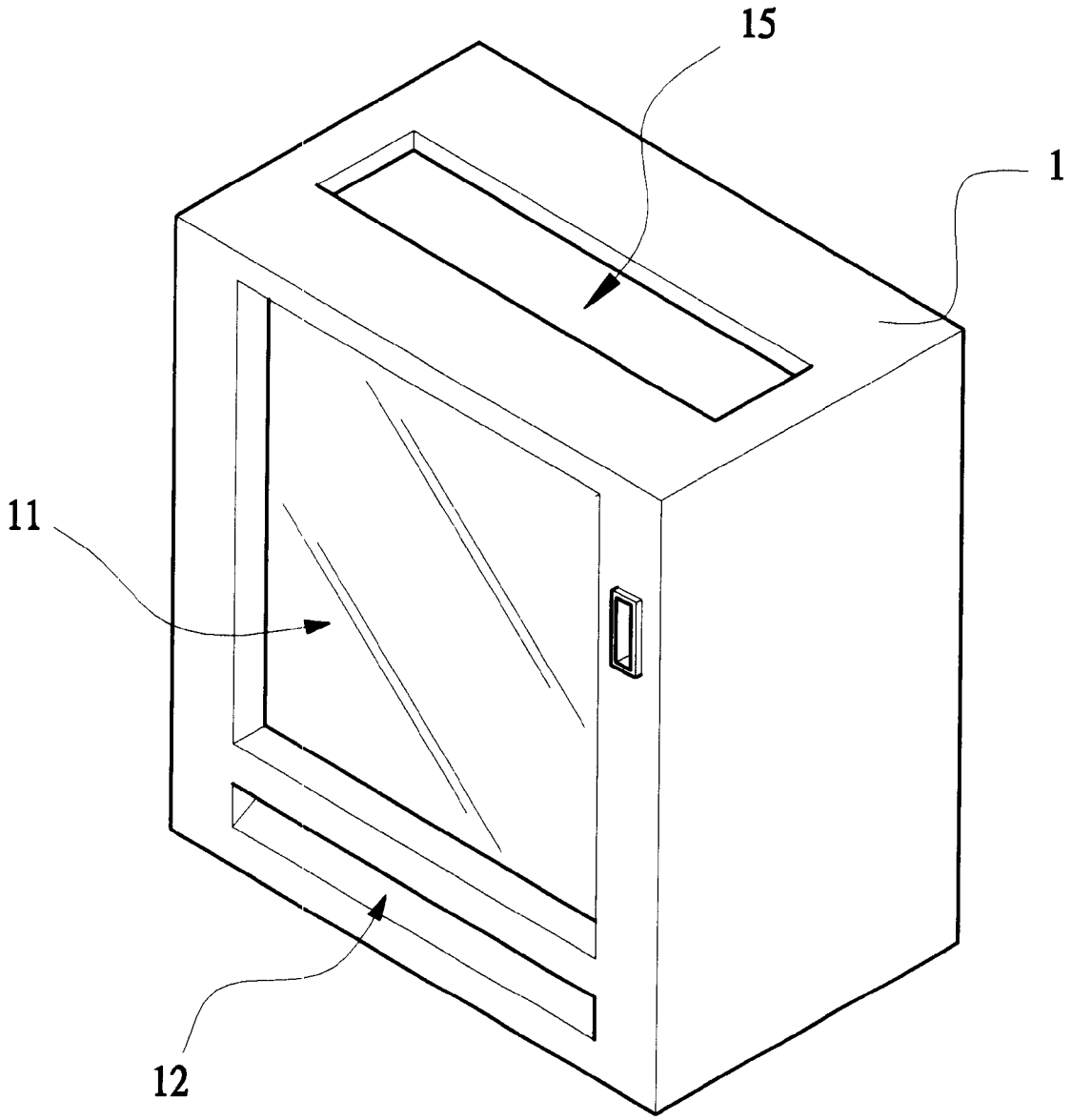
FIG. 1 is a perspective view of the present invention.
Figure 2:
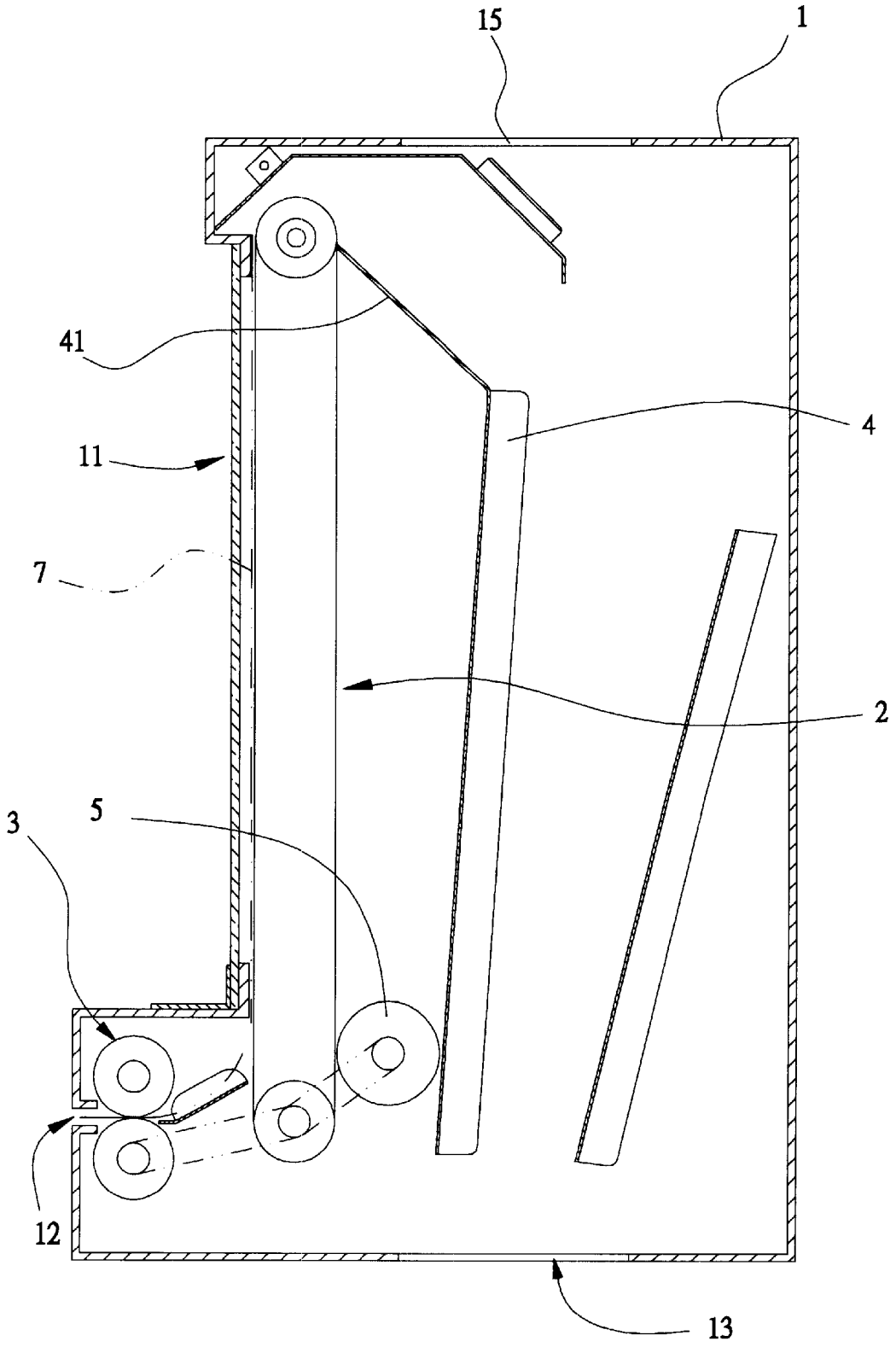
FIG. 2 is a cross-sectional view of the present invention.

Referring to FIG. 1 and FIG. 2, the present invention is composed of a box 1 with a transparent front panel 11, a static electricity conveyer 2 behind the transparent front panel 11, a paper entrance 12 on the bottom of the transparent front panel 11, a pair of rollers 3 behind the paper entrance 12 as paper feeder, a paper guiding board 4 behind the static electricity conveyer 2, a thin plate 41 is on top of the paper guiding board 4 and leans on the static electricity conveyer 2, a bottom hole 13 on the bottom of the box 1 and beneath the paper guiding board 4, a motor 5 drives the static electricity conveyer 2 and the pair of paper rollers 3, the motor 5 is connected to the coin slot 61 of a coin machine 6. Users can drop coins to trigger motor 5 to drive static electricity conveyer 2 and the pair of paper rolls 3.

Based on above description, after dropping the coins, a user can feed the advertisement paper 7 into the paper entrance 12 on the front end of box 1. The coin machine 6 is triggered by coins dropped to start motor 5. The pair of rollers 3 will bring advertisement paper 7 to static electricity conveyer 2. The static electricity conveyer 2 sucks the advertisement paper 7 via static electricity and moves the advertisement paper 7 facing the transparent front panel 11 on the box 1, the advertisement paper now can be seen by everyone.

Figure 3:
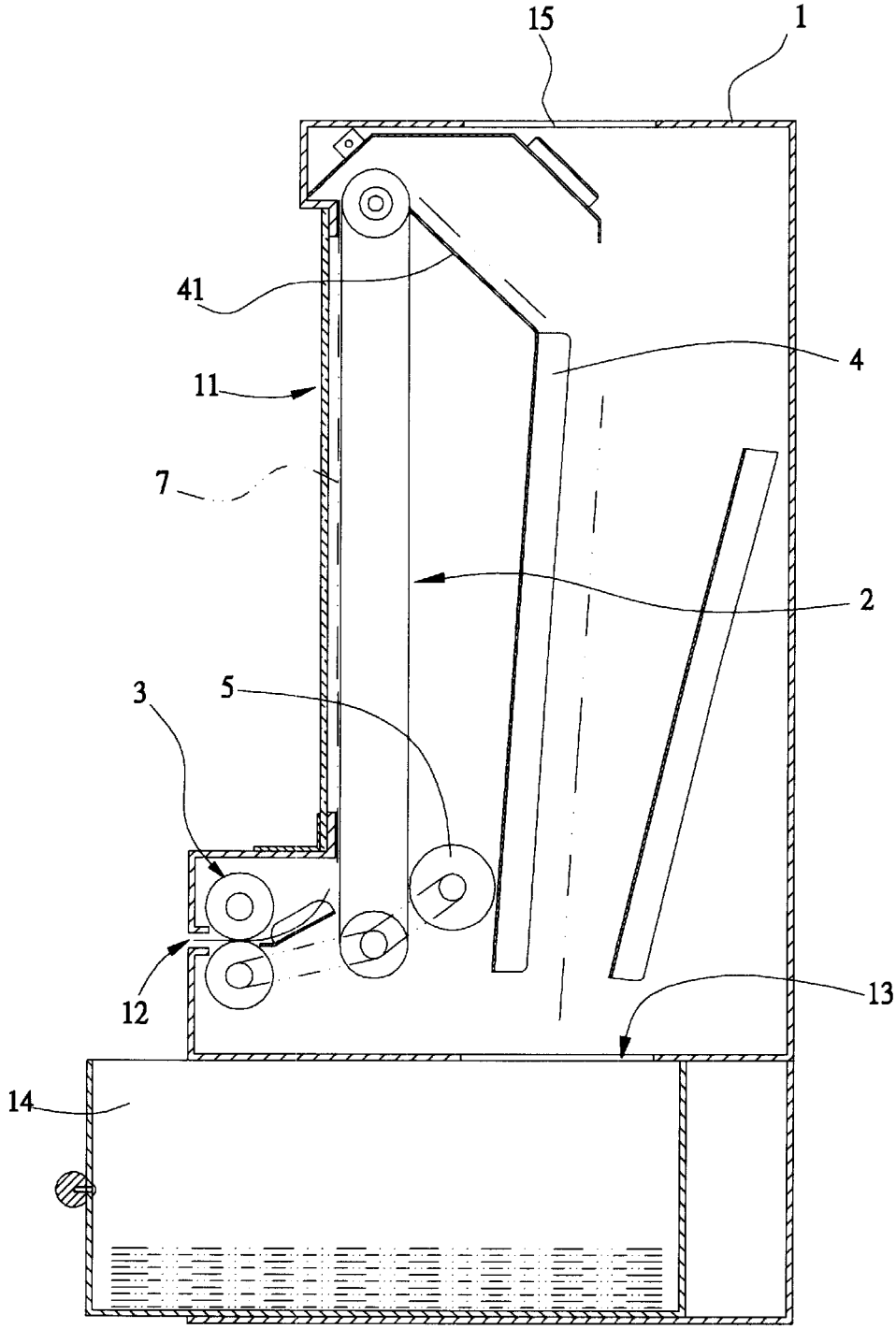
FIG.3 is a cross-sectional view of an embodiment of the present invention.
Figure 4:
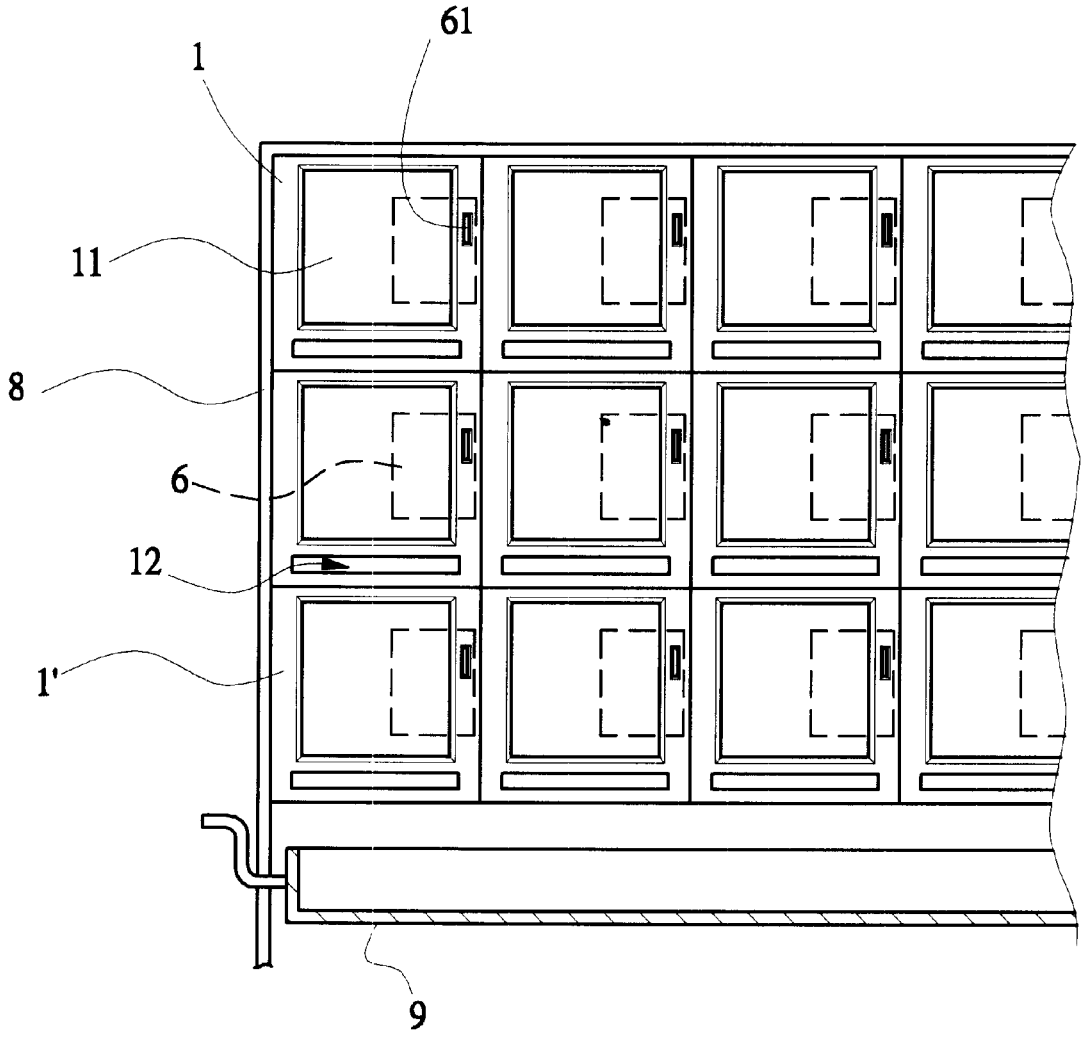
FIG. 4 is a front view of another embodiment of the present invention.
Figure 5:
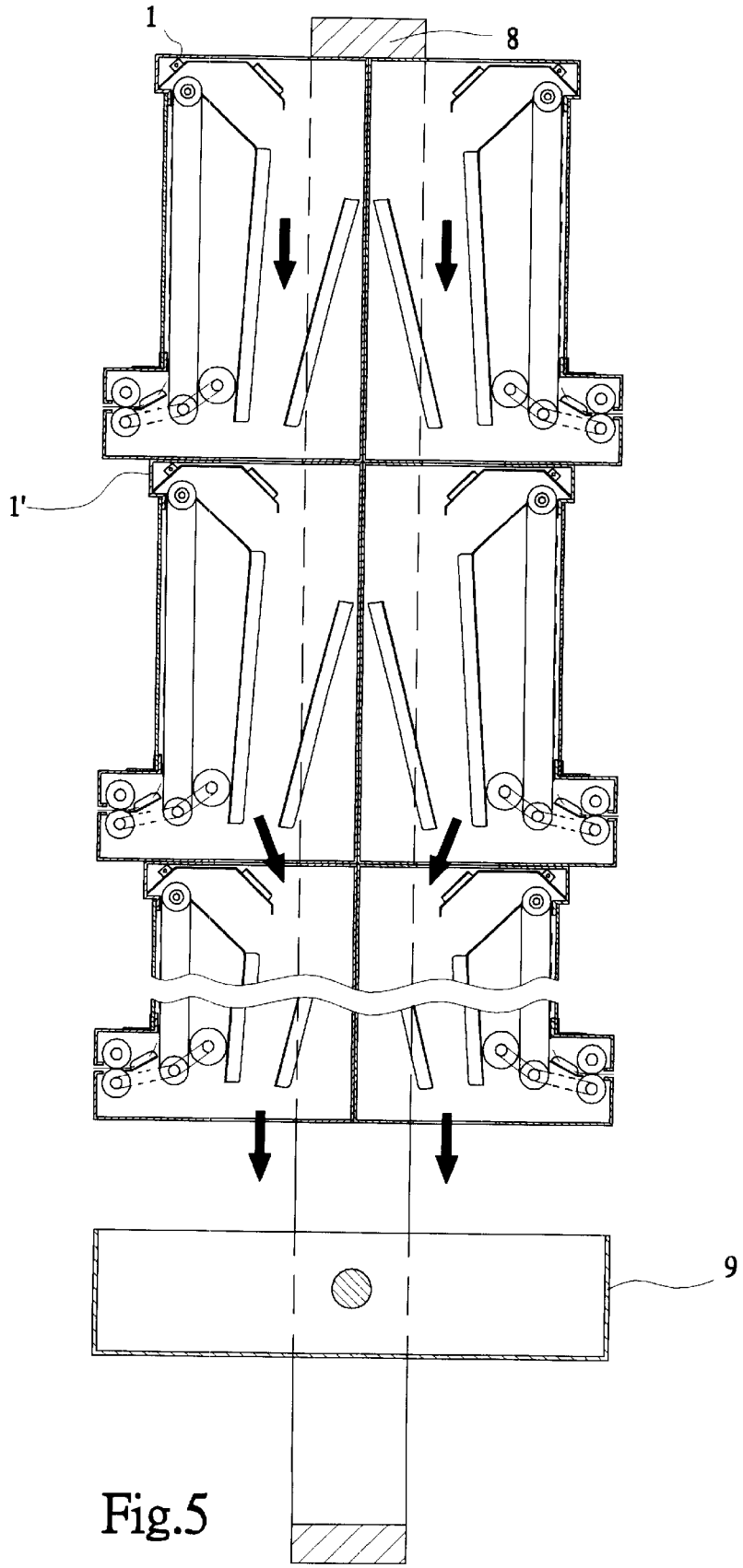
FIG. 5 is a side view of FIG. 4.

After a period of preset time, the coin machine 6 issues a command starting motor 5 to roll the static electricity conveyer 2. Since the thin plate 41 is lean on the static electricity conveyer 2, therefore when the static electricity conveyer 2 rolls the advertisement paper 7 to the location of the thin plate 41, the advertisement paper 7 is separated from the static electricity conveyer 2. The advertisement paper 7 slides out from the bottom hole 13 on the bottom of the box 1 through the paper guiding board 4. Referring to FIG. 3, beneath the bottom hole 13 of the box 1, there is a recycle box 14. All the advertisement paper 7 inside the box 1 eventually drop into the recycle paper 14. The waste in the recycle box 14 can be clear periodically and easily without extra effort. Referring to FIG. 4 and FIG. 5, there is a top hole 15 on top of the box 1, the top hole 15 is on right top of the paper guiding board 4. A plurality of box 1 can be installed within a frame rack 8. The bottom hole 13 of the upper box 1 is above the top hole 15' of the lower box 1'. A Revolving recycle rack 9 is on lower portion of the frame rack 8.

A single or double sided bulletin wall can be constructed with multiple box 1 inside a frame rack 8, such arrangement make more people display their advertisements or messages. When anyone of the box 1 reaches the due time, the advertisement paper 7 is dropped to another box 1' through its top hole 15 and down to the revolving recycle rack 9 on the lower portion of the frame rack 8. After a certain period of time, just roll over the revolving recycle rack 9 to clean up all the advertisement paper 7 in the revolving recycle rack 9, it is easy and save lots of manpower.

While a preferred embodiment of the invention has been shown and described in detail, it will be readily understood and appreciated that numerous omissions, changes and additions may be made without departing from the spirit and scope of the invention.

What is claimed is:

1. A coin-op bulletin board comprising:

a box;

a transparent front panel attached to the front side of said box;

a static electricity conveyer installed behind said transparent front panel;

a paper entrance disposed under said transparent front panel with a pair of rollers as paper feeder being provided behind said paper entrance;

a paper guiding board installed behind said static electricity conveyer;

a bottom hole situated at the bottom end of said box and beneath said paper guiding board;

a thin plate is fitted between the top end of said paper guiding board and the top of said static electricity conveyer;

a motor used to drive said static electricity conveyer and said pair of rollers; and a coin machine with a slot being connected to said motor so that said motor drives said static electricity conveyer and said pair of rollers by means of said coin machine.

2. The coin-op bulletin board recited in claim 1, wherein a recycle box is provided beneath said bottom hole of said box.

3. The coin-op bulletin board recited in claim 1, wherein a top hole is disposed at the top of said box and above said paper guiding board, and a plurality of said boxes are piled up inside a frame rack by means that said bottom hole of said box is situated on said top hole of another box, and a revolving recycle rack is mounted on the lower portion of said frame rack.

* * * * *